United States Patent [19]

Barnard

[11] 4,117,807

[45] Oct. 3, 1978

[54] FUEL INJECTION CUT OFF MEANS FOR OVER TEMPERATURE PROTECTION OF EXHAUST TREATMENT DEVICE

[75] Inventor: Daniel D. Barnard, Farmington Hills, Mich.

[73] Assignee: The Bendix Corporation, Southfield, Mich.

[21] Appl. No.: 765,019

[22] Filed: Feb. 2, 1977

[51] Int. Cl.[2] ..... F02B 3/00

[52] U.S. Cl. ..... 123/32 EE; 60/277; 123/198 DB; 324/16 R

[58] Field of Search ..... 123/32 EA, 32 EE, 32 EK, 123/119 ED, 119 EC, 198 A, 198 D, 198 F, 198 DC, 198 B, DIG. 11; 324/15, 16 R, 16 T, 16 S, 17, 18, 19; 60/277, 285; 73/346

[56] References Cited

U.S. PATENT DOCUMENTS

| | | | |
|---|---|---|---|
| 3,889,647 | 6/1975 | Rachel | 123/32 EA |
| 3,942,102 | 3/1976 | Ruhn et al. | 324/16 R |
| 4,015,428 | 4/1977 | Kawai | 60/277 |
| 4,023,358 | 5/1977 | Maurer et al. | 123/198 DB |
| 4,024,850 | 5/1977 | Peter et al. | 123/198 DB |
| 4,040,294 | 8/1977 | Matsuda et al. | 60/277 |

*Primary Examiner*—Charles J. Myhre
*Assistant Examiner*—R. A. Nelly
*Attorney, Agent, or Firm*—Gaylord P. Haas, Jr.; Russel C. Wells

[57] ABSTRACT

For use with internal combustion engines equipped with electronic fuel injection systems and engine exhaust treatment devices, means for detecting spark plug misfiring resulting in excessive exhaust treatment device operating temperatures and for thereupon inhibiting fuel injection to protect the exhaust treatment devices from damage or destruction caused by the excessive temperatures.

8 Claims, 1 Drawing Figure

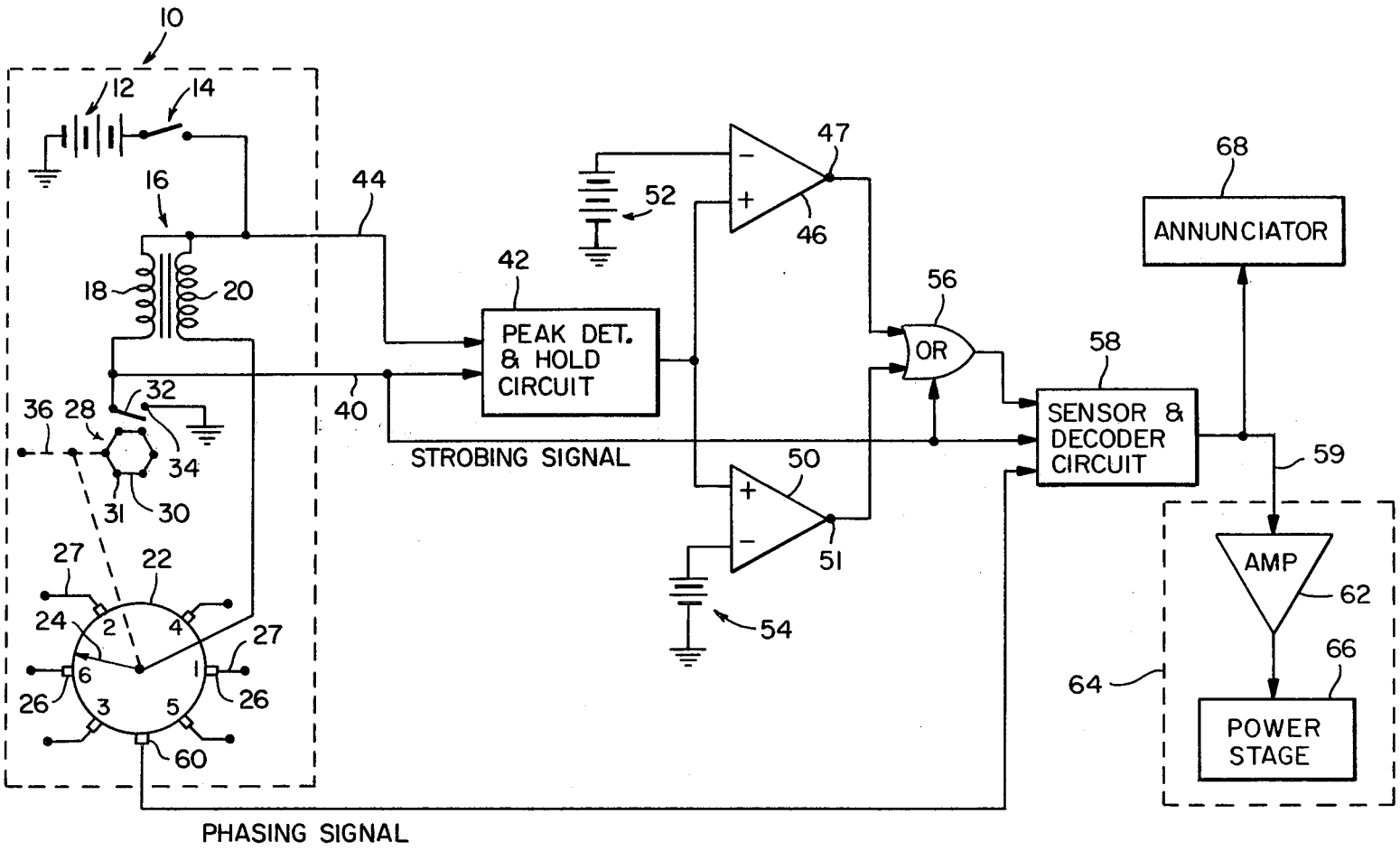
ANNUNCIATOR
68
59
AMP
62
66
POWER STAGE
64
SENSOR & DECODER CIRCUIT
58
OR
56
47
46
50
51
54
52
PEAK DET. & HOLD CIRCUIT
42
STROBING SIGNAL
44
40
PHASING SIGNAL
10
14
12
16
20
18
32
34
30
31
28
36
22
27
26
24
60
1
2
3
4
5
6

FUEL INJECTION CUT OFF MEANS FOR OVER TEMPERATURE PROTECTION OF EXHAUST TREATMENT DEVICE

BACKGROUND OF THE INVENTION

1. Field of the Invention

This invention relates generally to internal combustion engines equipped with electronic fuel injection systems and exhaust treatment devices. More particularly this invention relates to means associated with engines of the type described for detecting engine malfunctions that could cause excessive temperatures which might damage or destroy the exhaust treatment device.

2. Description of the Prior Art

Complete control of exhaust emissions from internal combustion engines, with the possible exception of gas turbines, appears to require treatment of the exhaust products with catalytic converters and/or manifold thermal reactors. Both of these exhaust treatment devices depend upon achieving and maintaining relatively high temperatures to complete the oxidation and/or reduction of the exhaust emission products. The devices are designed to operate safely at temperatures based upon normal engine operation. However, it is known that a misfiring engine can result in substantial temperature increases within the exhaust treatment device to the point that the exhaust treatment structure can be oxidized or otherwise damaged or destroyed. This occurs because each engine misfire allows the unburned fuel/air charge in the particular cylinder subject to the misfire to be discharged into the highly reactive environment of the exhaust treatment device, whereby the energy normally released in the cylinder to produce power is converted into heat that results in temperatures beyond the design limits of the exhaust treatment device. Prior to the present invention there has not been apparatus for detecting such misfiring and for inhibiting operation of the engine in response thereto.

SUMMARY OF THE INVENTION

This invention contemplates apparatus for use with an internal combustion engine of the type including a spark ignition system having igniting means (spark plugs) normally operating within a desired voltage range. If, for example, a spark plug or lead is open, a higher than normal voltage will occur and a shorted plug will cause a lower than normal voltage to occur. The invention detects the operating voltage for the several spark plugs of the engine and compares this voltage to high and low reference voltages which define the desired operating voltage range. An error voltage is provided for each spark pulse that occurs outside the desired range, and which occurrence indicates an engine misfire. The error signal is gated and strobed to isolate the individual spark pulse, which is thereafter decoded to provide an inhibit signal for inhibiting operation of the engine. The invention is particularly adaptable to engines including electronic fuel injection systems because the electrically actuated fuel injectors in these systems can be readily inhibited and the computation circuitry included in such systems offers easier adaptation to the logic circuitry required for processing spark plug misfire information as may be desired.

The main object of this invention is to provide means for use with a spark ignited internal combustion engine for detecting excessive operating temperatures caused by spark plug misfiring which could damage or destroy engine exhaust treatment devices associated with the engine.

Another object of this invention is to provide means of the type described which is particularly adaptable to engines having electronic fuel injection systems whereby a spark plug misfire is processed to provide an inhibit signal which prevents fuel from being injected to the corresponding engine cylinder, thereby preventing over temperature conditions which could damage or destroy the exhaust treatment device.

Another object of this invention is to detect the spark plug operating voltages and to compare these voltages to high and low voltages defining a desired operating voltage range. A signal is provided when a spark pulse falls outside of this range, and which signal is used to inhibit fuel delivery to the corresponding cylinder of the engine.

The foregoing and other objects and advantages of the invention will appear more fully hereinafter from a consideration of the detailed description which follows, taken together with the accompanying drawing wherein one embodiment of the invention is illustrated by way of example. It is to be expressly understood, however, that the drawing is for illustration purposes only and is not to be construed as defining the limits of the invention.

DESCRIPTION OF THE DRAWING

The single FIGURE in the drawing is a schematic diagram of a device incorporating the principles of the invention.

DESCRIPTION OF THE INVENTION

For purposes of illustration, the device of the invention will be described with reference to an internal combustion engine ignition system including an ignition coil, a distributor and a breaker arrangement, said ignition system being designated by the numeral 10 in the FIGURE.

Ignition system 10 includes an electrical power supply 12, which may be the battery of the vehicle powered by the internal combustion engine, and which battery 12 applies a twelve volt supply voltage through an ignition switch 14 to a conventional ignition coil 16. Ignition coil 16 includes a low voltage winding 18 and a high voltage winding 20 which are inductively coupled in the conventional manner.

A conventional distributor 22 includes a distributor arm 24 cooperating with a plurality of distributor contacts 26, and which contacts are individually numbered 1 through 6. In this connection it will be understood that the invention is being described in relation to a six cylinder engine, with the number of contacts corresponding to the number of cylinders in the engine, as the case may be.

A plurality of distributor cables 27 connect the individually numbered distributor contacts 26 with conventional type igniting means or spark plugs (not shown) associated with the cylinders of the engine in the usual manner.

A conventional breaker arrangement 28 includes a breaker cam 30 having six lobes 31 cooperating with a breaker arm 32 and a breaker contact 34.

High voltage winding 20 of ignition coil 16 is connected to distributor arm 24 and low voltage winding 18 is connected to breaker arm 32. Breaker contact 34 is connected to ground.

Distributor arm 24 and breaker cam 30 are rotatably driven from the engine crank shaft (not shown) through a distributor shaft 36 which makes a single revolution during each operating cycle of the engine.

As breaker cam 30 is rotated by distributor shaft 36, it repeatedly moves breaker arm 32 into and out of engagement with breaker contact 34 six times during each revolution of breaker cam 30 to develop a series of low voltage ignition pulses in low voltage winding 18 of coil 16. The low voltage ignition pulses are transformed into high voltage ignition pulses in high voltage winding 20 which applies the pulses to distributor arm 24. As distributor arm 24 is rotated by distributor shaft 36 it successively engages each of the individually numbered distributor contacts 26 once during each revolution of distributor arm 24 to apply the high voltage ignition pulses to energize the spark plugs through the respective distributor cables 27. The spark plugs each generate an ignition spark in response to the application of a high voltage ignition pulse. The ignition spark fires the associated one of the cylinders of the engine by igniting the air/fuel mixture to initiate combustion.

Only as much of ignition system 10 has been described as is necessary to set forth the invention. A more complete description of the ignition system is provided in U.S. Pat. No. 3,727,592, issued Apr. 17, 1973, to Lester Wilkinson and assigned to the General Motors Corporation.

It will be now understood that with an ignition system of the type described, a reflected voltage is produced in winding 18 which is proportional to the voltage in winding 20 as applied to the spark plugs of the system. During normal operation, a particular spark plug or spark plug set operates within a predetermined range of operating voltage as reflected in winding 18 of coil 16. If the spark plug or its cable 27 is open, a higher voltage is reflected in winding 18 and if the plug is shorted a lower voltage will be reflected. Thus, if the voltage in the low voltage winding of the coil is measured for each spark occurrence and compared to high and low limits, an error signal would appear with each spark pulse that falls outside of the predetermined range, and which error signal would be indicative of a spark plug misfire. The misfire could ultimately lead to over temperature conditions and potential damage to or destruction of the engine exhaust treatment device as heretofore noted. The device of the invention detects such a misfire to inhibit fuel injection to the engine as will be next described.

As heretofore noted, as breaker cam 30 is rotated by distributor shaft 36 is repeatedly moves breaker arm 32 into and out of engagement with breaker contact 34 six times during each revolution of breaker cam 30 through the displacement of lobes 31 to develop a series of low voltage ignition pulses which are applied to coil winding 18. The low voltage ignition pulses are applied through a conductor 40 to a conventional type peak detector and hold circuit 42.

Low voltage winding 18 is connected through a conductor 44 to circuit 42. Circuit 42, in effect, measures the voltage of winding 18 which is proportional to the voltage of winding 20 as applied to the spark plugs of the system for each spark occurrence provided.

The output of circuit 42, which corresponds to this measurement, is applied to the non-inverting input terminals (+) of an amplifier 46 and an amplifier 50. A suitable high voltage reference source, such as a battery 52, is connected to inverting input (−) terminal of amplifier 46 and a suitable low voltage reference source, such as a battery 54, is connected to the inverting input (−) terminal of amplifier 50. The outputs at output terminals 47 and 51 of amplifiers 46 and 50, respectively, are applied to a conventional type OR gate 56. OR gate 56 provides an output when either one or the other of the inputs to amplifiers 46 and 50 fall outside the voltage range defined by batteries 52 and 54, which is a normal spark plug operating voltage range. The low voltage ignition pulses provided upon the closure of breaker arm 32 through cam lobes 30 are applied to OR gate 56 to provide a strobing signal to the gate in order to isolate the particular spark pulse falling outside of the defined voltage range.

The output from OR gate 56, which is actually an error signal, is applied to a conventional sensor and decoder circuit 58. The strobing signal is applied to circuit 58 as is a phasing signal provided at an additional contact 60 disposed on distributor 22. It will be understood that a phasing signal will be provided at contact 60 for each revolution of distributor arm 24 to provide a position reference for the decoding function of circuit 58.

Circuit 58 senses the signal from OR gate 56 and decodes the signal in accordance with the applied strobing and phasing signals to provide an inhibit signal at an output conductor 59 for inhibiting the appropriate fuel injector or injectors in an electronic fuel injection system.

The signal from circuit 58 is applied to a feed back control amplifier 62 included in an electronic control unit 64 of the electronic fuel injecton system which may be of the type well known in the art. The signal controls a power stage 66 of electronic control unit 64 to inhibit fuel injection upon a spark plug misfire detected as heretofore described.

In effect, then, the signal from circuit 58, which is applied to electronic control unit 64, prevents fuel delivery to the engine cylinder corresponding to the misfiring spark plug during subsequent engine cycle. The inhibiting effect thus provided prevents excessive unburned fuel from reaching the exhaust treatment device and thereby protects said device from damage or destruction caused by over temperature conditions resulting from the misfiring.

It is noted that circuit 58 may include a suitable arrangement of logic elements providing the aforenoted sensing and decoding in response to the input signals thereto provide the inhibit signal at output conductor 59. In this connection, circuit 58 could also include logic which would return fuel delivery after a given number of proper spark pulses. This would prevent a momentary misfire from stopping fuel delivery to the cylinder corresponding to the misfiring spark plug for prolonged periods, and would also prevent a closely spaced intermittent misfire from causing excessive unburned fuel to reach the engine emission control device with the damaging or destructive results as aforenoted.

As an auxiliary element to the invention, an annunciator 68 could be connected to conductor 59. Annunciator 68 would provide a visual or audible warning to the vehicle operator that a misfiring is occurring. Normal diagnostic procedures could be used to determined the particular spark plug which is misfiring.

It will now be understood from the aforegoing description of the invention with reference to the drawing, that a device for use with an internal combustion engine of the type including an electronic fuel injection system and an exhaust treatment device has been disclosed which features means for detecting spark plug misfiring resulting in excessive engine operating temperatures and for inhibiting fuel injection to the corresponding engine cylinder to protect the exhaust treatment device from the excessive temperatures as long as the spark plug misfiring exists.

Essentially, the invention as described teaches fuel injector cut off means for exhaust reactor over temperature protection by detecting the misfiring a spark plug as a function of the voltage in the low voltage winding of the engine ignition coil. Fuel flow is then cut off or inhibited to prevent a flow of unburned fuel through the engine that would be ignited by and destroy the engine exhaust treatment device.

Although the device of the invention has been described with reference to a conventional ignition system including a coil, distributor and breaker arrangement, it is to be understood that the invention is applicable as well to an electronic ignition system, the same providing the described ignition pulses, strobing signal and phasing signal as will now be understood by those skilled in the art.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. For use with an internal combustion engine equipped with an electronic fuel injection system including a plurality of injectors, apparatus for detecting misfiring of at least one of a plurality of fuel ignitors and for inhibiting operation of the electronic fuel injection system to certain of the plurality of injectors in response thereto, comprising:

means for providing a signal for each of a plurality of fuel ignition occurrences including the misfiring of the fuel ignitors;

means for providing a signal proportional to said fuel ignition occurrence signal;

means responsive to the fuel ignition occurrence signals and said proportional signal for detecting the level of the proportional signal for each of the plurality of fuel ignition occurrences and for providing a corresponding signal;

comparison means including means establishing a signal range for comparing the signal from the detecting means to said signal range and for providing comparison signals for providing an error signal when at least one of the fuel ignition occurrence signals falls outside of the predetermined signal range to indicate a corresponding fuel ignitor misfire; and means responsive to the error signal for providing an inhibit signal for inhibiting a fuel injector in the electronic fuel injection system corresponding to the certain of the misfiring fuel ignitor.

2. Apparatus as described in claim 1 further including fuel ignitor reference signal, said error signal being additionally responsive to said occurrence signals and said reference signal.

3. Apparatus as described by claim 2, wherein the means for comparing the signal from the detecting means to signals defining a predetermined signal range and for providing comparison signals includes:

a first amplifier having an inverting input terminals, a non-inverting input terminal and an output terminal;

a second amplifier having an inverting input terminal, a non-inverting input terminal and an output terminal;

a source of high voltage connected to the inverting input terminal of the first amplifier;

a source of low voltage connected to the inverting input terminal of the second amplifier;

the high and low voltages defining the predetermined signal range;

the determining means connected to the non-inverting input terminals of the first and second amplifiers so that the signal from the detecting means is compared to the high and low voltages defining the predetermined signal range, with the comparison signals provided at the output terminals of the respective first and second amplifiers.

4. Apparatus as described by claim 2, wherein:

the fuel ignitor reference signal is a signal indicative of the phasing of the plurality of fuel ignition occurrences.

5. Apparatus as described by claim 2, including:

an annunciator connected to the inhibit signal means and responsive to the signal therefrom for annunciating a misfiring fuel injector.

6. Apparatus as described by claim 2, wherein:

the electronic fuel injection system includes an electronic control unit having a feedback control amplifier which drives a power stage; and the feedback control amplifier is connected to the last mentioned means and responsive to the inhibit fuel injection.

7. Apparatus as described by claim 3, wherein the means responsive to the comparison signals and the fuel ignition occurrence signals for providing an error signal when at least one of the fuel ignition occurrence signals falls outside of the predetermined signal range to indicate a corresponding fuel ignitor misfire includes:

gating means connected to the output terminals of the first and second amplifiers for providing an error signal when one of the comparison signals falls outside of the predetermined range; and the gating means connected to the means for providing a signal for each of a plurality of fuel injection occurrences, said signal being a strobing signal for isolating the fuel ignition occurrence signal which falls outside of the predetermined range.

8. Apparatus as described by claim 7, wherein the means responsive to the error signal, the fuel ignition occurrence signals and the fuel ignitor reference signal for providing an inhibit signal for inhibiting a fuel injector in the electronic fuel injection system corresponding to the misfiring fuel ignitor includes:

sensing and decoding means connected to the gating means, the means for providing a signal for each of a plurality of fuel injection occurrences, said signal being the strobing signal, and to the fuel ignitor reference signal means, for sensing the error signal and for decoding the sensed signal in accordance with the strobing signal and the fuel ignitor reference signal for providing the inhibit signal.

* * * * *

UNITED STATES PATENT AND TRADEMARK OFFICE

CERTIFICATE OF CORRECTION

PATENT NO. : 4,117,807

DATED : October 3, 1978

INVENTOR(S) : Daniel D. Barnard

It is certified that error appears in the above-identified patent and that said Letters Patent are hereby corrected as shown below:

In the title, please change "INJECTION" to --INJECTOR--;

Column 4, line 32, change "injecton" to --injection--;

Column 4, line 49, between "thereto" and "provide" please insert --to--;

Column 6, line 15, change "determining" to --detecting--.

Signed and Sealed this

*Seventh* Day of *August 1979*

[SEAL]

*Attest:*

*Attesting Officer*

LUTRELLE F. PARKER

*Acting Commissioner of Patents and Trademarks*